US007505009B2

(12) United States Patent
Parsche et al.

(10) Patent No.: US 7,505,009 B2
(45) Date of Patent: Mar. 17, 2009

(54) POLARIZATION-DIVERSE ANTENNA ARRAY AND ASSOCIATED METHODS

(75) Inventors: Francis Eugene Parsche, Palm Bay, FL (US); Dennis Lee Tebbe, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 324 days.

(21) Appl. No.: 11/609,037

(22) Filed: Dec. 11, 2006

(65) Prior Publication Data

US 2008/0136721 A1 Jun. 12, 2008

(51) Int. Cl.
*H01Q 7/00* (2006.01)

(52) U.S. Cl. ..... 343/742; 343/743; 343/797; 343/815

(58) Field of Classification Search ..... 343/726, 343/741, 742, 743, 792, 797, 815, 866
See application file for complete search history.

(56) References Cited

U.S. PATENT DOCUMENTS

| | | | | |
|---|---|---|---|---|
| 1,892,221 | A | 12/1932 | Runge | |
| 2,615,134 | A | 10/1952 | Carter | |
| 3,474,452 | A | 10/1969 | Bogner | |
| 4,160,978 | A | 7/1979 | DuHamel | 343/742 |
| 4,183,027 | A * | 1/1980 | Ehrenspeck | 343/726 |
| 4,588,993 | A * | 5/1986 | Babij et al. | 342/351 |
| 5,838,283 | A | 11/1998 | Nakano | 343/741 |
| 5,900,842 | A * | 5/1999 | Coleman | 343/742 |
| 5,977,921 | A | 11/1999 | Niccolai et al. | 343/741 |
| 6,317,091 | B1 * | 11/2001 | Oppelt | 343/742 |
| 6,356,771 | B1 * | 3/2002 | Dent | 455/562.1 |
| 6,515,632 | B1 * | 2/2003 | McLean | 343/741 |
| 6,522,302 | B1 | 2/2003 | Iwasaki | 343/726 |
| 6,809,693 | B2 * | 10/2004 | Andrews et al. | 343/725 |
| 6,888,510 | B2 * | 5/2005 | Jo et al. | 343/797 |
| 6,911,947 | B1 * | 6/2005 | Cranor et al. | 343/741 |
| 2002/0098807 | A1 | 7/2002 | Saarnimo | 455/74 |

OTHER PUBLICATIONS

Ojiro et al., "A Monopole-Fed Circularly Polarized Loop Antenna", Institute of Information Sciences & Electronics, University of Tsukuba, Japan; 1998 IEEE, No. 0-7803-4478-2.
David Jefferies, "Intermediate-sized Loop Antennas", p. 1-15; Internet: www.ee.surrey.ac.uk/personal/d.jefferies.

* cited by examiner

*Primary Examiner*—Douglas W. Owens
*Assistant Examiner*—Chuc Tran
(74) *Attorney, Agent, or Firm*—Allen, Dyer, Doppelt, Milbrath & Gilchrist, P.A.

(57) ABSTRACT

The polarization-diverse antenna array includes three orthogonal loop antennas having a common center, e.g. together defining a sphere. Each loop antenna includes a loop electrical conductor. Two signal feedpoints are along the loop electrical conductor and separated by a fraction of a length of the loop electrical conductor. Each of the signal feedpoints includes a series signal feedpoint so that a polarization diversity controller coupled thereto may selectively provide vertical, horizontal, lefthand circular and righthand circular polarization for a single loop electrical conductor, including simultaneous (dual) polarizations. These signal feedpoints may supply signals with vertical, horizontal, lefthand circular and righthand circular polarization from each of the three orthogonal look-angles provided by the three loop electrical conductors. Thus the antenna array may provide a compact facility for using Diversity Combining to improve communications performance and/or Multiple-Input, Multiple-Output (MIMO) schemes that furthermore also increase capacity. The polarization-diverse antenna array provides a rigorous polarization and look angle approach for communications diversity.

20 Claims, 6 Drawing Sheets

POLARIZATION-DIVERSE ANTENNA ARRAY AND ASSOCIATED METHODS

GOVERNMENT LICENSE RIGHTS

This invention was made was made with Government support under Contract No. NBCH-C-05-0056 awarded by the United States Department of Defense. The Government has certain rights in this invention.

FIELD OF THE INVENTION

The present invention relates to the field of communications, and, more particularly, to antennas for wireless communications and related methods.

BACKGROUND OF THE INVENTION

For background, an antenna is a transducer that converts radio frequency electric current to electromagnetic waves that are radiated into space. The antenna may also convert electromagnetic waves into electric current. The electric field or "E" plane determines the polarization or orientation of the radio wave. Most antennas operate using either linear or circular polarization.

A linearly polarized antenna radiates in one plane. In a circularly polarized antenna, the plane of polarization rotates in a circle making one complete revolution during one period of the wave. If the rotation is clockwise in the direction of propagation, the sense is called right-hand-circular polarization (RHCP). If the rotation is counterclockwise, the sense is called left-hand-circular polarization (LHCP).

An antenna is said to be vertically polarized (linear) when its electric field is perpendicular to the Earth's surface. An example of a vertical antenna is a broadcast tower for AM radio or the "whip" antenna on an automobile. A horizontally polarized (linear) antenna has its electric field parallel to the Earth's surface. Television transmissions in the United States typically use horizontal polarization.

A rotational polarized wave radiates energy in both the horizontal and vertical planes and all planes in between. The difference, if any, between the maximum and the minimum peaks as the antenna is rotated through all angles, is called the axial ratio or ellipticity and is usually specified in decibels (dB). If the axial ratio is near 0 dB, the antenna is said to be circularly polarized. If the axial ratio is greater than 1-2 dB, the polarization is often referred to as elliptical. Circular polarization is an example of elliptical polarization, with an axial ratio of 0 dB. Circular is a nominal term in practice, as typical circularly polarized antennas are usually slightly elliptically polarized. Used herein, the term "circular" is intended to include elliptical.

Antennas are configured to receive and/or transmit a signal based on the polarization of the signal. In many instances, a single antenna is used to simultaneously receive and transmit different signals on orthogonal polarizations.

Many signals are used in communication systems and this requires diversity among the signals. One form of diversity includes spatial diversity. Spatial diversity includes separating antennas by some predetermined distance to assist in preventing interference from other signals. Interference can occur when a signal intended for one antenna is received by another antenna. An example of spatial diversity includes configuring an antenna structure to have multiple antennas spaced apart from one another for receiving and/or transmitting individual signals of a single polarization. Unfortunately, providing multiple antennas is costly and increases the physical load. Furthermore, antenna platform space is typically limited and spatial diversity increases the size.

So conventional approaches include multiple monopoles or dipoles with spatial diversity. Also, multiple monopoles are used with vertical or horizontal polarization diversity. A tripole antenna includes three dipoles oriented in three dimensions. If these conventional antennas provide multipath mitigation such as diversity reception, and/or multiple-input, multiple-output (MIMO), then they typically: may not be compact and ruggedized; may require some positioning and/or adjustment; may not be three-dimensionally omnidirectional; and may not be useable near or attachable to some surfaces.

Another form of diversity includes polarization diversity. Polarization diversity includes simultaneously radiating or receiving multiple polarizations, as a propagation path may fade in one polarization but not in another.

Another form of diversity includes angular diversity. Angular diversity includes directive receive antennas scanning at various look angles. In some instances, the direct patch may be blocked by obstructions, but an indirect path available at other directions, such as say a reflection from a water tower. Rich multipath environments may even offer multiple communications channels on the same frequency, as for example using different water tower or building reflectors.

U.S. Pat. No. 4,588,993, to Babij et al, describes an antenna array including 3 dipoles and 3 loops, centered and operated on the 3 principal axis and planes. The elements are described as being electrically small such that loop circumferences are much much less than 1 wavelength. The array is oriented towards instrumentation and resolving near fields. Rotational polarization and communications diversity are not addressed.

What is needed is a compact antenna for a relay node in a mobile network used, for example, during urban operations in a multipath environment. The antenna should preferably be small, lightweight and inexpensive. The antenna may be quickly deployable without the need to adjust the position, and it may be able to be attached or placed on any material. Such an antenna is preferably three-dimensionally omnidirectional, and may support multipath mitigation such as diversity reception, and/or multiple-input, multiple-output (MIMO).

SUMMARY OF THE INVENTION

In view of the foregoing background, it is therefore an object of the present invention to provide a compact antenna that includes polarization diversity and is three-dimensionally omnidirectional, i.e. having beams covering any look angle.

This and other objects, features, and advantages in accordance with the present invention are provided by a polarization-diverse antenna array including three orthogonal loop antennas having a common center, e.g. together defining a sphere. Each loop antenna comprises a loop electrical conductor, e.g. a circular electrical conductor. Two signal feedpoints are along the loop electrical conductor and separated by a fraction, e.g. a quarter, of a length of the loop electrical conductor. Each of the signal feedpoints includes a series signal feedpoint so that a polarization diversity controller coupled thereto selectively provides vertical, horizontal, lefthand circular and righthand circular polarization for said loop electrical conductor.

Also, the signal feedpoints may supply signals with vertical, horizontal, lefthand circular and righthand circular polarization from each of three orthogonal look-angles provided by the three loop electrical conductors.

Each of the series signal feedpoints may define a discontinuity in the loop electrical conductor. The signal feedpoints may further include a two-wire transmission line connected in series at the respective series signal feedpoint. Also, a feed structure may be connected to the series signal feedpoints.

Another aspect of the invention is directed to a wireless node for use in a communications network. The wireless node includes a communications processor for processing incoming and outgoing signals, and including a polarization diversity controller. A polarization-diverse antenna array operates in connection with the communications processor to receive and transmit the incoming and outgoing signals respectively, and comprises three orthogonal loop antennas having a common center. Each loop antenna includes a loop electrical conductor, and two signal feedpoints along the loop electrical conductor and separated by a fraction of a length of the loop electrical conductor. Each of the signal feedpoints comprises a series signal feedpoint so that the polarization diversity controller selectively provides vertical, horizontal, lefthand circular and righthand circular polarization for said loop electrical conductor.

A feed structure may connect the polarization diversity controller to the series signal feedpoints of the polarization-diverse antenna array. Also, the communications processor may be positioned within a sphere defined by the three orthogonal loop antennas.

A method aspect of the invention is directed to a method of making a polarization-diverse antenna array including forming three orthogonal loop antennas to have a common center and each comprising a loop electrical conductor, e.g. a circular electrical conductor, and forming two signal feedpoints along each loop electrical conductor and separated by a fraction of a length of the loop electrical conductor. Each of the signal feedpoints includes a series signal feedpoint so that a polarization diversity controller coupled thereto selectively provides vertical, horizontal, lefthand circular and righthand circular polarization for the loop electrical conductor.

Forming each series signal feedpoint may comprise forming a discontinuity in the loop electrical conductor. The method may include connecting a feed structure connected to the series signal feedpoints.

The antenna is small, lightweight and inexpensive. The antenna may be quickly deployable without the need to adjust the position, and it may be able to be attached or placed on any material. Such an antenna is preferably three-dimensionally omnidirectional, and may support multipath mitigation such as diversity reception, and/or multiple-input, multiple-output (MIMO). Deployment of the antenna and/or node may be by attachment (e.g. sticking it on a wall or post) or by tossing (throwing, rolling, or setting it down). No manual positioning is necessary by the user.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
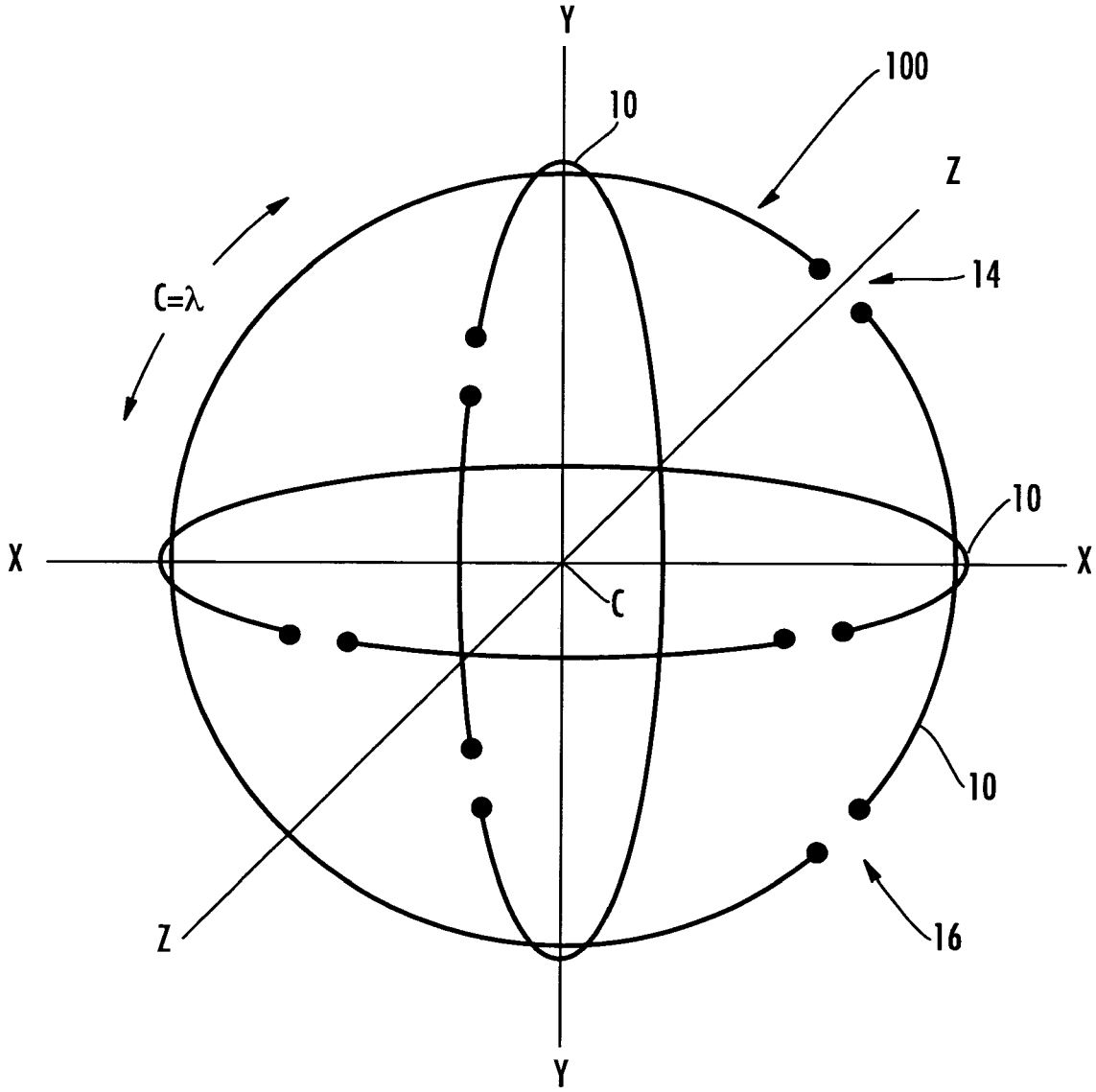
FIG. 1 is a schematic diagram of the present invention polarization-diverse antenna array, illustrating the three orthogonal circular loops and associated feed points.
Figure 2:
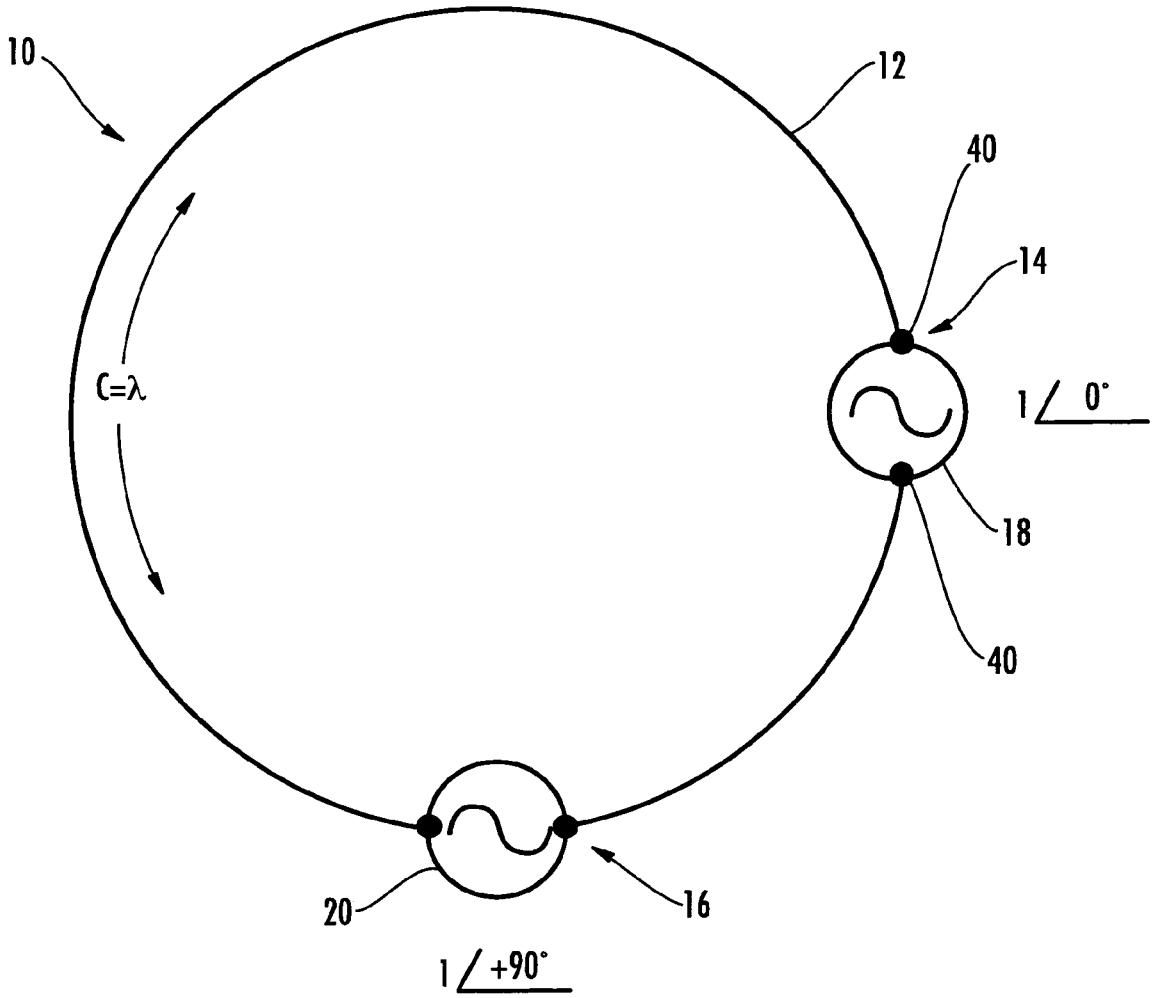
FIG. 2 is a schematic diagram of an embodiment of a single circular loop antenna of the polarization-diverse antenna array of FIG. 1, providing right hand circular polarization out of the page.
Figure 3:
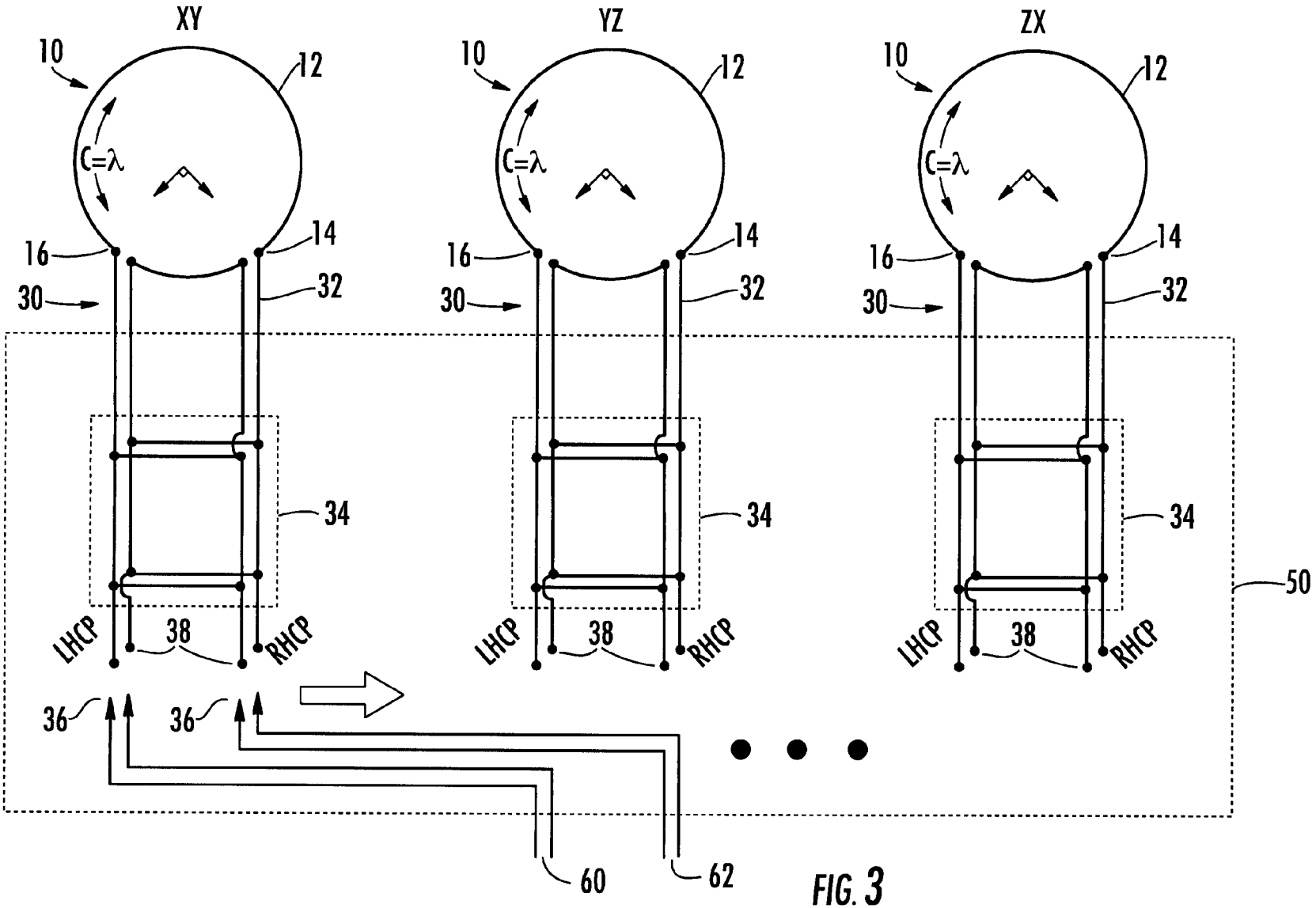
FIG. 3 is a schematic diagram of the circular loop antennas of the polarization diverse antenna array of FIG. 1 including an example of a feed structure in accordance with an embodiment of the present invention.

Referring initially to FIGS. 1-3, a compact antenna array 100 that includes polarization diversity and is three-dimensionally omnidirectional will now be described. The polarization-diverse antenna array 100 includes three orthogonal loop antennas 10 having a common center C and lying on a common spherical surface. Each loop antenna 10 comprises a loop electrical conductor 12, e.g. a circular electrical conductor. A circle is one of the two canonical antenna structures (lines and circles, corresponding to dipoles and loops) and the circle is the most fundamental single element capable of circular polarization. In the present description, the term "circular" is intended to also include elliptical.

The loop electrical conductor 12 may be a conductive wire, tubing, trace etc., and the circumference is preferably equal to about one wavelength (e.g. between 0.9 and 1.1 wavelengths). The loop electrical conductors 12 do not touch adjacent orthogonal loop antennas 10, so insulated wire is a preferred embodiment. Of course other approaches for insulating the loop antennas at crossing points may also be used. Two signal feedpoints 14/16 are along the loop electrical conductor and separated by a fraction, e.g. a quarter, of a length of the loop electrical conductor. A signal feedpoint phase difference of ninety degrees is provided at the signal feedpoints 14, 16, such that signal feedpoints 14, 16 may be operated in phase quadrature: the necessary condition for circular polarization from loop electrical conductor 12. In the FIG. 2, right hand circular polarization (RHCP) is produced out of the page, and left hand circular polarization (LHCP) is produced into the page.

Each of the signal feedpoints includes series signal feedpoints so that a polarization diversity controller 50 may be coupled thereto to selectively provide vertical, horizontal, lefthand circular and righthand circular polarization for the loop electrical conductor. In other words, the signal feedpoints 14, 16 are in series in the loop electrical conductor 12. Each of the series signal feedpoints 14, 16 preferably defines a discontinuity in the loop electrical conductor 12. Each of the signal feedpoints 14, 16 may each have two terminals 40, as is typical.

The signal feedpoints may further include a feed structure such as a two-wire transmission line, e.g. open wire or coaxial cable 32, connected in series at the respective series signal feedpoint. Baluns may be used with coaxial cables, as is common.

Alternately, another approach is sending all (or some subset) of the received antenna signals to multiple RF-front-ends where they are all converted to digital signals. One or more digital signal processors then process all of the signals (e.g. in combination) to achieve the adaptively optimal improvement for the specific set of output signals. In this approach, on the receive-side of MIMO, there is no necessary use of a polarization controller in real-time. A controller may still be useful for reconfiguration, or for site-specific selection of diversity signals.

Multiple-Input, Multiple-Output transmission goes beyond just mitigating some or all forms of signal degradation. Using, for example, n outputs at the transmitter instead of one, and using n inputs at the receiver instead of one, the total capacity of the transmissions is greater than a factor of n. The simple but profound benefit of MIMO has been taken in many research directions with many good results. The full benefit of MIMO uses signal processing at both the transmitter and the receiver ends of the path. The n transmissions paths may be uncorrelated, orthogonal or independent to some extent and the more the better. This is where diversity comes in to play. Spatial separation of antennas decreases the signal correlation, with greater separation yielding better results. Greater spatial separation is not desirable on a handheld transceiver, and therein lies one of the benefits of polarization diversity in providing an alternate or supplemental approach for antenna diversity. And circular polarization provides a benefit in providing orthogonal signals.

An example of a signal feeding approach will be described with additional reference to FIG. 3. A feed structure 30 includes a transmission line 32 such as coaxial cable or balanced line connected in series at the respective series signal feedpoint 14, 16. Hybrid junctions 34 provide power division and phasing to signal feedpoints 14, 16, driving loop electrical conductor 12, via transmission line 32. Hybrid junctions 34 may be of the quadrature type (90 degree hybrid) in order to produce circular polarization, or they may be of the 0 or 180 degree type to produce linear polarization. For simplicity, the branch line type of quadrature hybrid is depicted In FIG. 3. Switches 36 select between the XY, YZ and ZX plane loops, and right and left hand circular polarization (or vertical and horizontal linear for 0 degree hybrids) from the selected loop antenna 10. Ports 60, 62 may interface the polarization diverse antenna array 100 to a two-way radio or satellite terminal, for example.

Each loop antenna 10 may simultaneously provide vertical and horizontal (i.e. dual linear) polarization, or simultaneous right hand circular and left hand (i.e. dual circular) polarization from two isolated ports 38, depending on the type of hybrid configured. Different polarizations may have the effect of producing greater penetration into buildings and difficult reception areas than a signal with just one plane of polarization. In dual linear loop polarization mode the vertical and horizontal polarized ports are isolated from one another, and may also be used as independent communication channels, or for duplex communications. For instance, a transmitter may be included at one of the signal feedpoints, and a receiver used at the other.

The present invention is not so limited however as to the FIG. 3 arrangement of the diversity controller 50, and alternative switching arrangements may be configured. As will be apparent to those skilled in the art, switches 36 may be of the matrix or crosspoint type, and fewer or more ports 60, 62 utilized. Loop antenna(s) 10, in conjunction with hybrid junctions 34, provide a versatile array configurable for orthogonal polarizations, simultaneous polarizations, and multiple look angles, to one or multiple receivers and transmitters.

Both righthand and lefthand circular polarization senses are of course possible with this invention by controlling the phasing (e.g. reversing the phasing). Fed in quadrature for circular polarization, loop antenna 10 has a current distribution that is uniform in amplitude and linear in phase, and the present invention is an antenna of the traveling wave type. The uniform current distribution produces a high, e.g. maximum, possible gain for area, without superdirectivity. The radiated field of the loop conductor in the Z direction (normal to the loop plane) has a constant magnitude over time which is described by $$E=(\cos^2 \omega t+\sin^2 \omega t)^{1/2}=1$$

which is the necessary condition for circular polarization.

When fed in phase for linear polarization, loop antenna 10 has a current distribution that is sinusoidal in amplitude and piecewise in phase, and the present invention is then an antenna of the standing wave type.

The present invention is not so limited as to require full wave circumference loops. With dual feedpoints one quarter circle apart, circular polarization is maintained into electrically small loop size. Loop radiation pattern and impedance however move with frequency, and full wave circumference loop size may be preferential for those considerations. The full wave loop is resonant with a useful driving point resistance of about 130 ohms.

If only linear polarization is required, polarization diversity controller 50 may be simplified by omitting hybrid junctions 34. At full wave circumference, signal feedpoints 14, 16 on loop antenna 10 are isolated from one another, making loop antenna 10 in effect a radiating branch line hybrid.

A preferred embodiment for signal feedpoints 14, 16 is to form them from discontinuities in loop conductor 12. The invention is not so limited however as to require discontinuities. Parallel approaches are also suitable for signal feedpoints 14, 16, such as the gamma or Y match as are common with dipole and Yagi-Uda antennas.

The present invention provides circular polarization from a single loop element. Prior art approaches to circular polarization from loops may have emphasized a different approach: turnstiling. In loop turnstiling, two electrically small loops have been normally positioned (forming "eggbeaters") and fed at 90 degrees relative phase, as in the George Brown (Dipole) Turnstile. The present invention does not operate on the turnstiling principle, but rather on the traveling wave principle of linear phase progression around the circumference of the single loop conductor. In the present invention, the loop current spins at $2\pi f$ revolutions per second.

A method aspect of the invention is directed to making a circularly polarized loop antenna 10 by forming an electrical conductor into a loop 12, and forming a plurality of signal feedpoints 14, 16 along the loop electrical conductor. Each of the signal feedpoints 14, 16 comprises a series signal feedpoint so that at least one signal source 18, 20 connected to the series feedpoints provides circular polarization for the loop electrical conductor 12.

Forming the plurality of signal feed points 14, 16 may include forming discontinuities in the loop electrical conductor 12, and forming the loop electrical conductor may comprise forming a circular electrical conductor. Providing the plurality of signal feed points 14, 16 may further comprise connecting a two-wire transmission line 32 in series at the respective series signal feedpoint. A feed structure 30 may be connected in to the series signal feedpoints 14, 16. The loop electrical conductor 12 may have a length equal to one wavelength, that is, the circumference of loop electrical conductor 12 may be one wavelength.

Figure 4:
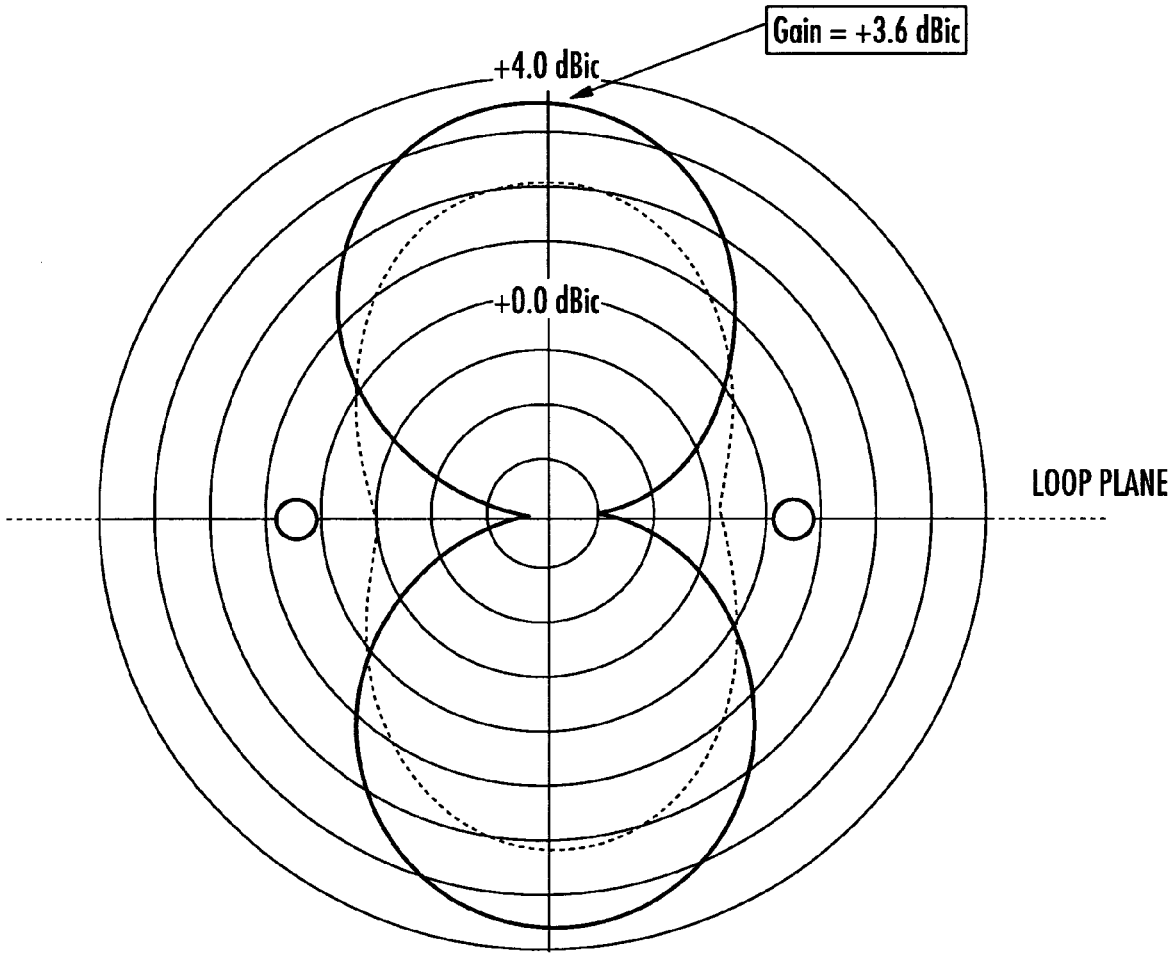
FIG. 4 is a graph depicting a predicted elevation plane radiation pattern normal to the loop plane of the single circular loop antenna of FIG. 2.
Figure 5:
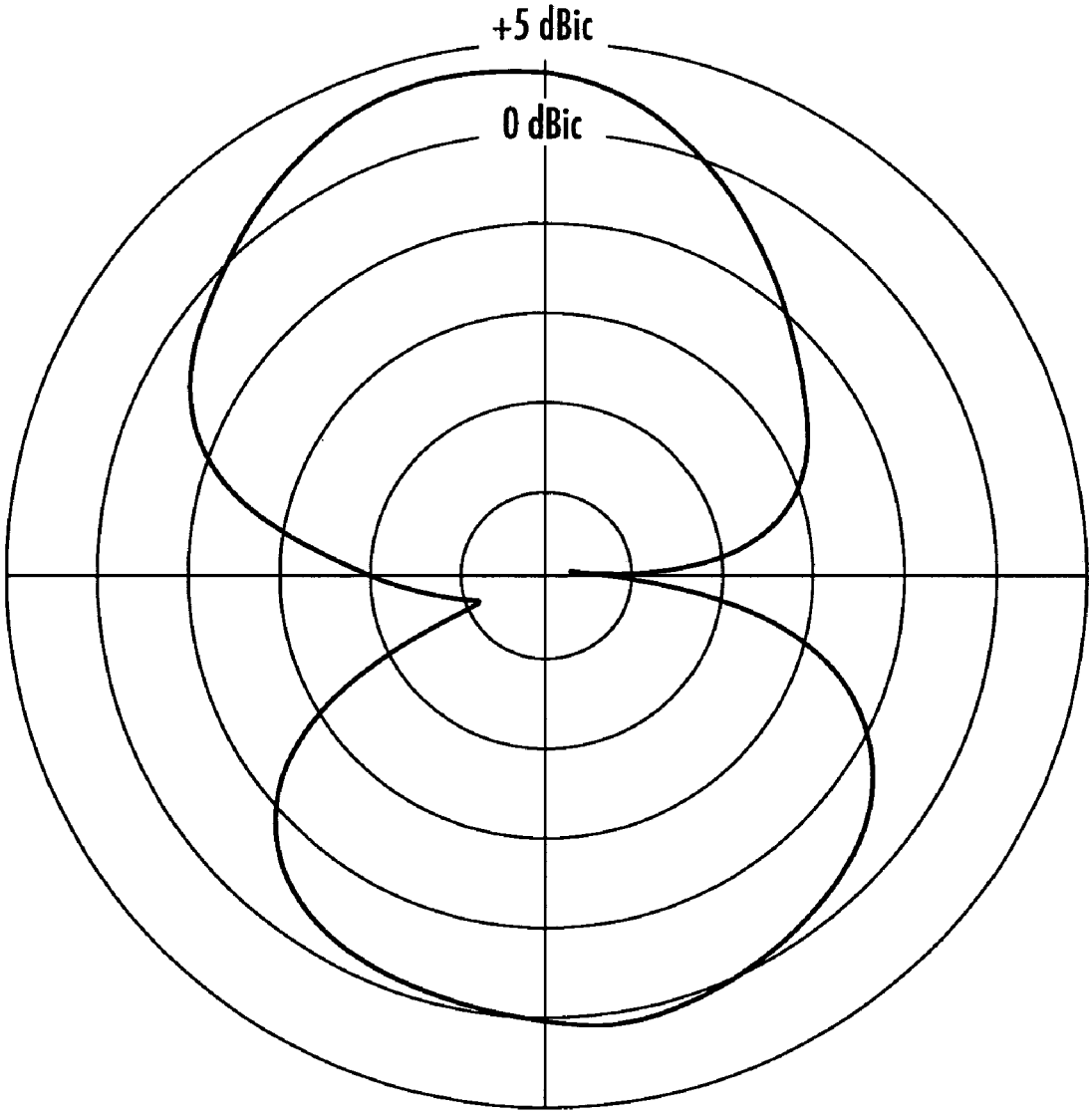
FIG. 5 is a measured elevation cut radiation pattern from a prototype of the polarization diverse antenna array of FIG. 1.

FIG. 4 is a graph depicting a predicted (moment method/NEC4 code) elevation plane radiation pattern cut (normal to the loop plane). This is for a single circular loop antenna element 10 of FIG. 2, quadrature fed for circular polarization. FIG. 5 is a plot depicting a measured elevation plane radiation pattern cut from a physical prototype of the polarization diverse antenna array, as shown of FIG. 1. The FIG. 4 and FIG. 5 gain units are dBic, indicating that the gain is expressed in decibels relative to an isotropic radiator that is circularly polarized.

Figure 6:
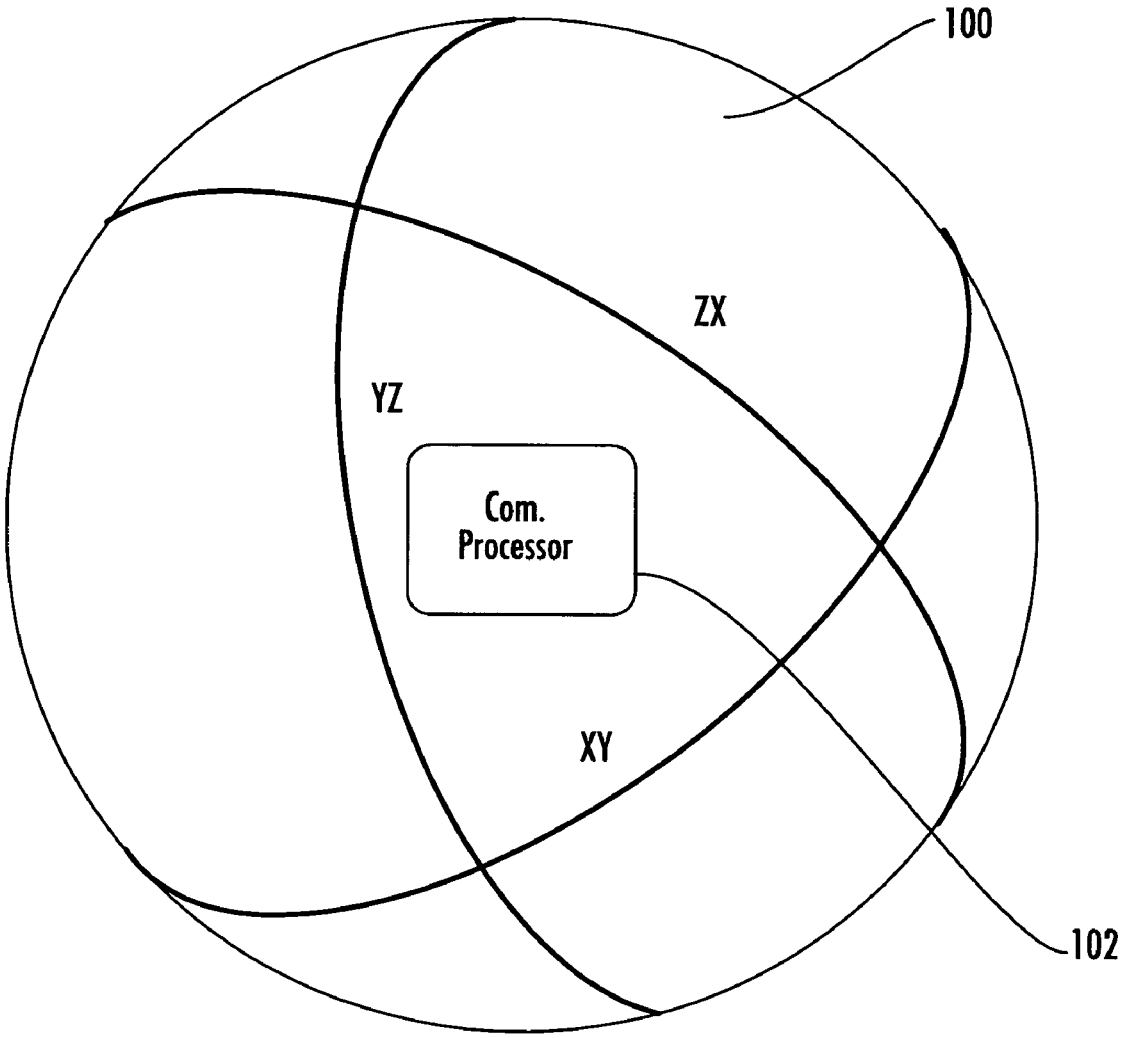
FIG. 6 is a three-dimensional schematic diagram of a wireless node including a communications processor and polarization-diverse antenna array in accordance with the present invention.

Another aspect of the invention is directed to a wireless node N (FIG. 6) for use in a communications network. The wireless node N includes a communications processor 102 for processing incoming and outgoing signals, and may include the diversity controller 50. A polarization-diverse antenna array 100 operates in connection with the communications processor 102 to receive and transmit the incoming and outgoing signals respectively, and comprises three orthogonal loop antennas 10 having a common center. The communications processor 102 may be positioned within a sphere defined by the three orthogonal loop antennas, as illustrated.

The antenna of the present invention is relatively small, lightweight and inexpensive. The antenna may be quickly deployable without the need to adjust the position, and it may be able to be attached or placed on any material. Such an antenna is preferably three-dimensionally omnidirectional, and may support multipath mitigation such as diversity reception, and/or multiple-input, multiple-output (MIMO). Deployment of the antenna and/or node may be by attachment (e.g. sticking it on a wall or post) or by tossing (throwing, rolling, or setting it down). No manual positioning is necessary by the user. Large quantities of the present invention may be sowed into an area, say to form an add hoc network.

The three orthogonal loops include reconfigurable or switchable modes of polarization. Each of three orthogonal loops can be either vertical V or horizontal H polarized or each can be lefthand L or righthand R circularly polarized. Thus, there are twelve (3×4=12) operational states from 3 beams and 4 cardinal polarizations.

The polarization modes can be reconfigurable as either deployment configurations or production configurations. The modes can be adaptively switched in the field: at any time, up to twelve independent polarization states are selectable by a diversity receiver. At each deployed location, the transceiver adaptively selects a site-specific best diversity-mode.

The polarization diversity antenna array (PDAA) may be the antenna of choice for compact devices that must operate reliably in the midst of heavy urban multipath. The PDAA may be the preferred antenna for compact devices that must be used indoors also. The PDAA is an excellent antenna for multiple input, multiple output (MIMO) processing to increase data-rate capacity and improve end-to-end reliability. The PDAA may be an optional antenna for small, handheld, secure WLAN devices (e.g utilizing 802.11a,b,g wireless technology). The PDAA is an excellent antenna for small, low-cost, wireless sensors.

Accordingly, a polarization diverse antenna array is provided, yielding a rigorous approach to communications diversity. Individual phase centered full wave loops provide the range of polarization types, linear or circular. Dual simultaneous polarization is provided for full duplex communications or frequency reuse. The array is versatile: those skilled in the art may configure the polarization diversity controller 50 to switch beams, polarizations, and radio ports for custom communications system requirements.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A polarization-diverse antenna array comprising:

three orthogonal loop antennas having a common center and each comprising a loop electrical conductor, and two signal feedpoints along the loop electrical conductor and separated by a quarter of a length of the loop electrical conductor, each of said signal feedpoints comprising a series signal feedpoint so that a polarization diversity controller coupled thereto selectively provides vertical, horizontal, lefthand circular and righthand circular polarization for said loop electrical conductor.

2. The polarization-diverse antenna array according to claim 1, wherein each of said series signal feedpoints defines a discontinuity in said loop electrical conductor.

3. The polarization-diverse antenna array according to claim 1, wherein said loop electrical conductor comprises a circular electrical conductor.

4. The polarization-diverse antenna array according to claim 1, wherein at least one of said signal feedpoints further comprises a two-wire transmission line connected in series at said respective series signal feedpoint.

5. The polarization-diverse antenna array according to claim 1, further comprising a feed structure connected to said series signal feedpoints.

6. The polarization-diverse antenna array according to claim 1, wherein the three orthogonal loop antennas together define a sphere.

7. A polarization-diverse antenna array comprising:

three of orthogonal loop antennas having a common center and each comprising a loop electrical conductor and at least one signal feedpoint; and at least one of the three of loop antennas having two signal feedpoints along the loop electrical conductor and separated by about a fraction of a length of the loop electrical conductor so that the signal feedpoints supply signals with vertical, horizontal, lefthand circular and righthand circular polarization from each of three orthogonal look-angles provided by the three loop electrical conductors.

8. The polarization-diverse antenna array according to claim 7, wherein each of said signal feedpoints defines a discontinuity in said loop electrical conductor.

9. The polarization-diverse antenna array according to claim 7, wherein said loop electrical conductor comprises a circular electrical conductor.

10. The polarization-diverse antenna array according to claim 7, wherein at least one of said signal feedpoints further comprises a two-wire transmission line connected in series at said signal feedpoint.

11. The polarization-diverse antenna array according to claim 7, further comprising a feed structure connected to said signal feedpoints.

12. A wireless node for use in a communications network, the wireless node comprising:

a communications processor for processing incoming and outgoing signals, and including a polarization diversity controller; and a polarization-diverse antenna array operating in connection with the communications processor to receive and transmit the incoming and outgoing signals respectively, and comprising three orthogonal loop antennas having a common center;

each loop antenna comprising a loop electrical conductor, and two signal feedpoints along the loop electrical conductor and separated by a fraction of a length of the loop electrical conductor, each of said signal feedpoints comprising a series signal feedpoint so that the polarization diversity controller selectively provides vertical, horizontal, lefthand circular and righthand circular polarization for said loop electrical conductor.

13. The wireless node according to claim 12 wherein each of said series signal feedpoints defines a discontinuity in said loop electrical conductor.

14. The wireless node according to claim 12, wherein said loop electrical conductor comprises a circular electrical conductor.

15. The wireless node according to claim 12, further comprising a feed structure connecting the polarization diversity controller to the series signal feedpoints of the polarization-diverse antenna array.

16. The wireless node according to claim 12, wherein the communications processor is positioned within a sphere defined by the three orthogonal loop antennas.

17. A method of making a polarization-diverse antenna array comprising:

forming three orthogonal loop antennas to have a common center and each comprising a loop electrical conductor; and forming two signal feedpoints along each loop electrical conductor and separated by a fraction of a length of the loop electrical conductor;

each of said signal feedpoints comprising a series signal feedpoint so that a polarization diversity controller coupled thereto selectively provides vertical, horizontal, lefthand circular and righthand circular polarization for the loop electrical conductor.

18. The method according to claim 17, wherein forming each series signal feedpoint comprises forming a discontinuity in the loop electrical conductor.

19. The method according to claim 17, wherein forming the loop electrical conductor comprises forming a circular electrical conductor.

20. The method according to claim 17, further comprising connecting a feed structure connected to the series signal feedpoints.

* * * * *